US005620103A

United States Patent [19]

Vlah et al.

[11] Patent Number: 5,620,103

[45] Date of Patent: Apr. 15, 1997

[54] DISPLAY RACK

[75] Inventors: John A. Vlah, Burton; Joseph J. Smith, Wooster; Michael Ksiezyk, Parma; John Caterinacci, Maple Hts.; Theresa M. Patton, Avon Lake, all of Ohio

[73] Assignee: American Greetings Corporation, Cleveland, Ohio

[21] Appl. No.: 435,996

[22] Filed: May 5, 1995

[51] Int. Cl.[6] ..... A47F 7/00

[52] U.S. Cl. ..... 211/55; 211/175; 211/189

[58] Field of Search ..... 211/55, 175, 189, 211/13, 195

[56] References Cited

U.S. PATENT DOCUMENTS

| | | | |
|---|---|---|---|
| D. 265,024 | 6/1982 | Johnson | D6/24 |
| D. 327,590 | 7/1992 | Hardy | D6/454 |
| D. 349,202 | 8/1994 | Eliadis | D6/467 |
| D. 351,076 | 10/1994 | Eliadis | D6/476 |
| 3,612,292 | 10/1971 | Nervig | 211/184 |
| 4,428,136 | 1/1984 | Franklin | 211/175 X |
| 4,621,878 | 11/1986 | Johnson | 312/257 R |
| 4,655,353 | 4/1987 | Johnson | 211/189 |
| 4,657,149 | 4/1987 | Masson | 211/195 X |
| 5,109,994 | 5/1992 | Kidd et al. | 211/175 X |

*Primary Examiner*—Philip C. Kannan
*Attorney, Agent, or Firm*—Oldham & Oldham Co. L.P.A.

[57] ABSTRACT

A modular rack unit for displaying greeting cards and the like comprises a base, three upstanding support members, two top rails and four panel assemblies. Each upstanding support member has its base end secured to the base so that it is substantially normal to the base's top planar surface. Two upstanding support members are end members, located at the front corners of the base and the third upstanding support member, has its base end positioned along the rear edge approximately midway between the first and second ends. The end upstanding support members are communicated to the central upstanding support member by the two top rails, so that the end upstanding support members, the central upstanding support member, the base, and the top rails form a pair of rectangular frame areas. Panel assemblies are positioned in each of the pair of rectangular frame areas so that a display face, adapted for receiving a plurality of means for displaying greeting cards or the like, on each panel assembly is outwardly directed. One of the panel assemblies in each of the rectangular frame areas faces another at an obtuse angle with the central upstanding support member forming the vertex of the obtuse angle. When end support members are shared by two abutting bases, the rack units may be linked together to form a linear rack display unit.

16 Claims, 6 Drawing Sheets

DISPLAY RACK

The present invention relates to a rack for displaying greeting cards, party supplies, wrapping paper and gifts. More particularly, the present invention relates to such a rack presenting flexibility of product presentation. Even more particularly, the present invention relates to a display rack having at least one pair of support frames situated at an obtuse angle to each other, permitting the eye of the consumer to be focused on a featured product.

BACKGROUND ART

A variety of display racks are known in the prior art. However, two goals in the art are to provide a display rack that efficiently displays the product and that draws consumer attention to the product. By efficient display, we mean a display that effectively shows the product in a format conducive to generating high sales per square foot of floor space occupied. As with any display structure that will be used in a retail setting, it is important that the display rack be as modular as possible for ease of assembly, disassembly and modification in the field. It is also a goal in the art to provide a two-sided display unit.

SUMMARY OF THE INVENTION

It is therefore, an object of the present invention to provide a modular display rack for goods such as greeting cards, party supplies, wrapping paper, small gifts and other similar items, wherein the presentation of the goods is made is an aesthetically attractive manner and wherein the display rack is capable of generating high sales per square foot of floor space occupied.

This and other objects of the present invention are achieved by a rack unit for displaying greeting cards and the like. The rack unit comprises a generally rectangular base, three upstanding support members, two top rails and four panel assemblies. The generally rectangular base has first and second end edges and first and second side edges, and in some applications, a significant portion constituting one of the corners of the base may be removed to provide better access to the displayed goods. Each of the three upstanding support members has a base end, mounted in or secured to the base, and a top end. Each of the upstanding support members is held in a position substantially normal to the top planar surface of the base. Two of the upstanding support members are end members, and are located at the first and second ends of the front edge of the base. The third upstanding support member, referred to as a central member, has its base end positioned along the second side edge approximately midway between the first and second ends of the base. Each of the end upstanding support members is communicated to the central upstanding support member by one of the two top rails. By doing this, each end upstanding support member, the central upstanding support member, the generally rectangular base, and the top rail form a rectangular frame area. Since there are two end members, two such rectangular frame areas are formed. When a first and a second panel assembly are positioned in each of the pair of rectangular frame areas, with the first and second panel assemblies in back to back relationship to each other, the display face on each panel assembly is directed outwardly from the rectangular frame area. So configured one panel assembly in each of the first and the second rectangular frame areas will face each other at an obtuse angle wherein the central upstanding support member forms a vertex of the obtuse angle. When this display face on the panel assembly is adapted for receiving a plurality of means for displaying greeting cards or the like, the goals of the present invention are achieved.

In a particular embodiment of the present invention, the central upstanding support member is hollow and has a lighting means affixed to its top end, so that it acts as a raceway to provide electrical power from the base to the lighting means. In such an embodiment, the lighting means comprises a gooseneck having a lamp base with a lamp and a shade at one end and mounting means for attachment to the central upstanding support member at the other end. The lamp base and lamp are preferably positioned to direct the light into the display area formed by the obtuse angle between the panel assemblies in the first and second rectangular frame areas. The crook in the gooseneck may be used for advertising indicia.

The plurality of means for displaying greeting cards or the like on the display face of the panel assemblies may comprise a plurality of sidewardly open greeting card holders. These are preferably sidewardly open greeting card holders aligned in a plurality of non-overlapping rows and a plurality of overlapping columns, particularly where the sidewardly open greeting card holders are open on the side thereof towards the end upstanding support member constituting part of the rectangular frame area wherein the sidewardly open greeting card holder is placed. At least some of the sidewardly open greeting card holders have an angled pocket formed therein for displaying a caption card.

In a particularly preferred embodiment, a portion of the display face of each of the panel assemblies that face each other at the obtuse angle coacts with an abutting portion of the other facing panel assembly to form an upwardly-pointed generally triangular display area starting along the first side edge of the rectangular base and ending along the central upstanding support member. The plurality of means for displaying greeting cards or the like in this area comprises a plurality of overlapping rows of display shelves, especially where at least one display shelf comprises at least two male members, one of them to be received into a corresponding female member formed in each of the facing panel assemblies, thereby retaining the facing panel assemblies in abutting relationship. A bottom-most said display shelf horizontally aligns one row of greeting cards with a corresponding row of the sidewardly open greeting card holders on the facing panel assemblies and the remaining said display shelves present two rows of greeting cards per row of the sidewardly open greeting card holders on the facing panel assemblies. An uppermost said display shelf is wide enough to display one greeting card and is mounted along the central upstanding support member.

In other embodiments of the present invention, additional rack units are chained together in a linked fashion by replacing one of the end members with a connecting upstanding support member that is secured to each of a pair of abutting bases, thereby doubling the length of the display rack. By adding rack units in this manner, the display rack may be fashioned to any desirable length. When additional units are added in this fashion, one obtuse-angled display area facing the front edge of the display rack is provided by each added rack unit, and one obtuse-angled display area facing in the opposite direction, that is, toward the rear edge, is provided by the interaction of panel assemblies on any abutting base edges.

BRIEF DESCRIPTION OF THE DRAWINGS

Better understanding of the present invention will be had when reference is made to the appended drawings, which are made a pad hereof, wherein identical pads are indicated by identical reference numerals, and wherein.

DETAILED DESCRIPTION OF THE DRAWINGS

Figure 1:
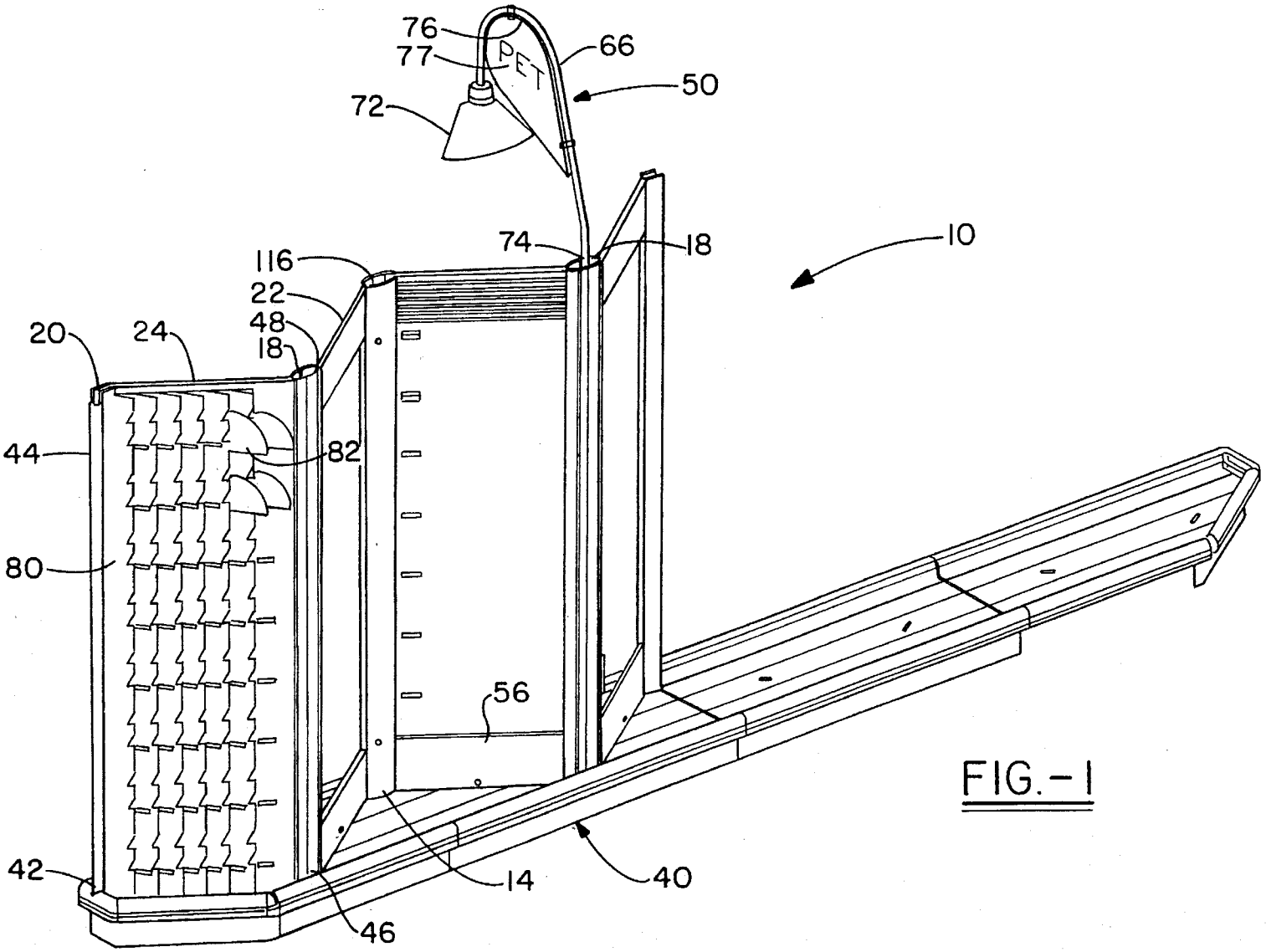
FIG. 1 is a perspective view from the rear side of a partially assembled display rack of the present invention having four rack units.

The display rack 10 of the present invention is available in several different embodiments, as will be taught herein, and as shown in FIGS. 1, 2, and 13–15. However, the concept of these embodiments is to present a flexible modular display arrangement that may be customized to the exact user. Therefore, when one understands the base unit upon which the larger embodiments are built, the larger embodiments will be readily understood.

Shown in top plan view in FIG. 13, the basic rack unit 12 of the present invention comprises a base 14, three upstanding support members 16, 18, 20, a pair of top rails 22, 24 and four panel assemblies 58, 60, 62, 64, which are positioned directly below top rails 22, 24 and which are best viewed in FIGS. 1 and 2. In larger constructs, as shown in top plan view in FIGS. 14 and 15 as well as in rear and front perspective view in FIGS. 1 and 2, respectively, one or two of the three upstanding support members may be shared with one or two linked adjacent rack units, and, indeed, these shared upstanding support members serve to link the adjacent rack units. However, these are the basic building blocks of the system, and each element, or an equivalent thereof, will be found in each unit.

The base 14 is a planar base, preferably constructed from an aluminum extrusion. In a preferred embodiment, the base 14 will be generally rectangular in top plan view, as shown in FIG. 13, with a pair of end edges, the first end edge 34 being parallel to the second end edge 36. In the preferred embodiment, these two end edges 34, 36 of the base 14 are about 48 inches apart. There are also two generally parallel side edges 38, 40, which are about 20 inches apart as these dimensions are convenient for retail settings and provide a comfortable angularity to the display, when the support members 16, 18, 20 are introduced, as described below. The twenty-inch width of the base 14 provides the completed display rack 10 with one of its most attractive features: it provides a two-sided greeting card display unit with a depth of less than two feet. Since the number of cards that can be displayed per unit of length of the display unit is essentially fixed by aesthetic limitations, it is this desirable small depth that gives the display rack a card density per square foot of footprint area that is very attractive to the retailer.

Figure 2:
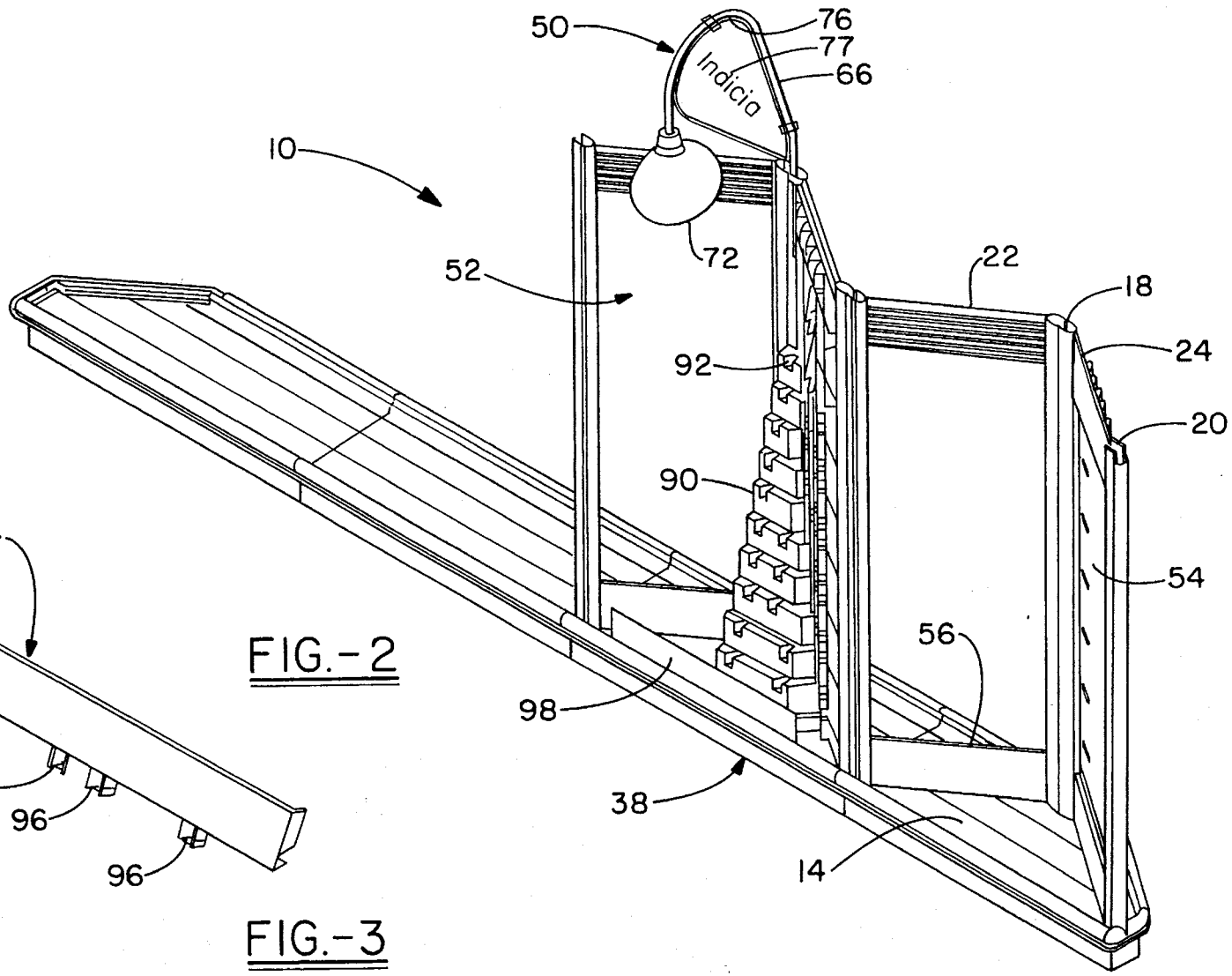
FIG. 2 is a perspective view from the front side of the partially assembled four unit display rack of FIG. 1.
Figure 13:
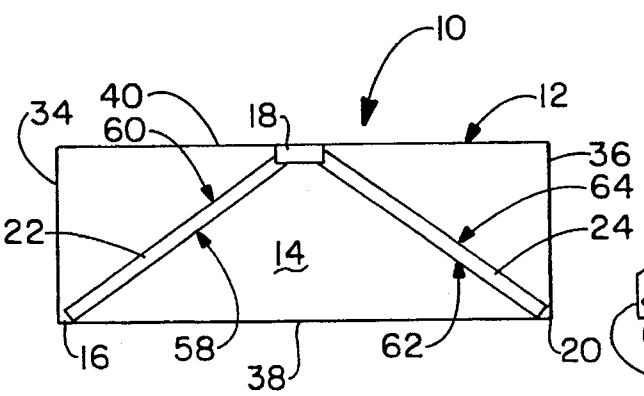
FIG. 13 is a top plan view of a one unit display rack of the present invention.

Referring now to FIGS. 1 and 13, an end upstanding support member 20 of the rack unit 10 is located at one front corner of the unit. This upstanding support member 20, as with all of the upstanding support members, has a base end 42 and a top end 44. The base end 42 is adapted to be securely mounted in the corner of the base 14. This upstanding support member 20, as with all of the upstanding support members 16, 18, 20 used in this invention, is preferably an aluminum extrusion and has a preferred height of about 73 inches. It is preferably mounted into the base 14 normal to the planar surface of the base. It will be immediately noted that the height of these upstanding support members 16, 18, 20 is more than 3.5 times the width of the base 14, which would in some instances raise concerns about the stability of the unit 10 to being tipped over. However, the oblique nature of the framing structures, as described below, lends stability to the unit, and the ability to use height increases the effective use of valuable floor space.

The second upstanding support member 18 is the central upstanding support member. It also has a base end 46 and a top end 48, and its base end is adapted to be securely mounted into the second side edge 40, or rear edge, of the base 14, approximately midway between the first and second ends 34,36. The preferred central upstanding member 18 will act as a focal point of a focused display area, so it will, in general, be wider along its length than the end upstanding support members 16, 20. In the most preferred embodiment, each central upstanding support member 18 serves as a base for a means 50 for directing light on the focal area of the display. Therefore, it is useful that the central upstanding support members 18 be hollow, so that electrical cord may be run therethrough the base to the top end, where the lighting means 50 is mounted.

The third upstanding support member 20 in this simplest embodiment is located at the second front corner of the base 14. It is not shown in FIGS. 2 and 3, since these show a partially assembled unit, but it is shown in FIG. 13. In the embodiment of FIG. 13, the third upstanding support member 20 is the mirror image of the first upstanding support member 16, and both serve as ends to the display rack 10.

Two rails 22, 24 are used to span the distance between the upstanding support members in the rack unit 10 and to frame out the areas from which the display assemblies will be installed. The first 22 of the rails connects the top of the first upstanding support member 16 to the top of the central upstanding support member 18. In doing so, the rail 22 cuts obliquely across the width of the base 14. In a similar fashion, the second top rail 24 connects the top end of the third upstanding support member 20 to the top end of the central upstanding support member 18. In some versions of the display rack, the upstanding support members 16, 20 positioned at the front (first side) edge 38 of the base 14 will serve as focal points for a focused display area, when viewed from the back or second side 40 of the display rack 10. Therefore, it is desirable in those applications to have hollow top rails 22, 24, which may act as raceways for electrical power to be supplied to lighting means 50 installed atop the upstanding support members. If, as described above, the electrical power is delivered to the top of a central upstanding support member 18, the power may be distributed to adjacent upstanding support members by use of the rail 22, 24 as a raceway.

The combination of the base 14, a front edge support member 16 or 20, a central rear edge support member 18 and a top rail 22 or 24 have formed an empty vertically-oriented rectangular display area. There are two such rectangular areas 52, 54, as shown in FIG. 2, located within each basic rack unit 12, the first such area 52 being associated with support member 16 and top rail 22 and the second such rectangular area 54 being associated with support member 20 and top rail 24. When viewed from directly atop the base 14, the rectangular areas 52, 54 project as lines defined by the top rails 22 and 24 respectively, the two lines being in an angular relationship. If base 14 were square and the width of the central support member 18 were small compared to the length of the base, the angle between the rectangular areas 52, 54 would be about 60°. If the base 14 is rectangular and the length is about twice that of the width, then the angle between the rectangular areas 52, 54 increases to about 90°, at which point it is no longer an acute angle, but is instead an obtuse angle, that is, an angle between 90° and 180°. For the purposes of the present invention, the preferred display area will result from an angle greater than 90°, and most preferably in the range of 100° to 115°. When the angle is too small, and particularly when the angle is acute, the greeting cards and the like displayed within the facing rectangular areas 52, 54 are too deep in the display to be readily accessible to consumers. When the angle is in the proper range, however, the open angle is attractive and inviting to consumers. Additionally, the length of display available, as measured along the top rails 22, 24 is increased by about 15 to about 30% from that which would be available in a traditional flat display. Display length and display height, both being enhanced by the invention, are multiplied together to obtain overall increased display area.

While the rectangular display area 52 or 54 may be formed from two upstanding support members 16 or 20 and 18, the base 14 and the top rail 22 or 24 connecting the tops of the two upstanding support members, it will be understood that a bottom rail 56 may also be used, with such a bottom rail providing a better vertical surface for attachment of a panel assembly to be inserted in the rectangular area 52, 54 than the base plate acting alone.

To fill the rectangular frame areas 52, 54 provided, a first and a second panel assembly 58, 60 and 62, 64 is positioned in each. These first 58, 60 and second 62, 64 panel assemblies are placed in back to back relationship to each other so that a display face on each panel assembly is directed outwardly from the rectangular frame area. In the simplest embodiment taught, as shown in FIG. 13, the display faces on two of the panel assemblies 58, 62 will face each other at an obtuse angle as described above. The remaining two display faces, on panel assemblies 60, 64, will face outwardly without a facing partner. Two of these "orphan" display faces will occur in each embodiment of the invention, one of the "orphan" faces at each end thereof. It will be preferred in some applications to cut off a corner of the otherwise rectangular base immediately in front of the "orphan" face to permit closer access to the face and to reduce the actual footprint of the display even further. This is shown in FIGS. 1, 2, 13 and 14. Each of the display faces of the four panel assemblies 58, 60, 62, 64, whether it is an orphan or not, is preferably adapted to receive a plurality of means for displaying greeting cards, wrapping paper, novelty items such as party supplies, and other appropriate items to be sold in a similar retail setting.

It will also be understood that while the present invention is being described in a fully modular state, there are circumstances where multiple pieces may be combined into a single piece which incorporates all of the functionality of the multiple pieces. Such combinatory pieces would be expected to fall within the scope of the present invention. For example, the functionality of at least one of the upstanding support members, the top and bottom rail and the first and second panel assemblies could be incorporated into a molded rectangular panel that would be fastened to the base or the base and another upstanding support member, such as a central upstanding support member. However, this combined piece would lack much of the modularity of the present invention as described.

A lighting means 50 is used for several reasons. Since the display is angled, the rectangular frame areas 52, 54 can shield each other off from the usual lighting in the retail setting. The angled display, while inviting and attractive if well lighted, can take on exactly the opposite aura if not well lighted. If lighting is to be used, it should focus the eye of the consumer to the focal point of the display area and hold that attention. For these reasons, a distinct lighting means 50 is preferred. A particularly preferred lighting means 50 comprises a gooseneck 66 having a lamp base with a lamp positioned inside a shade 72 at one end thereof and a means 74 for mounting the gooseneck to the central upstanding support member 18 at the other end thereof. It is particularly preferred to have the lighting means 50 be brightly colored. The crook 76 inherent in the gooseneck 66 shape is ideal for positioning advertising indicia 77. When mounted atop the central upstanding support member 18, the preferred lighting means 50 will extend directly out towards the front edge 38 of the base 14, and have its beam directed on the central upstanding support member at a height approximately 75% of the distance from bottom to top. A particularly preferred embodiment of the lamp and lamp base would incorporate lighting technology produced by General Electric Corporation, including a 2D fluorescent lamp and an electronic ballast. The preferred lamp shade 72 prevents the light from being directed at the consumer's eyes and focuses the light on the display area.

Figure 5:
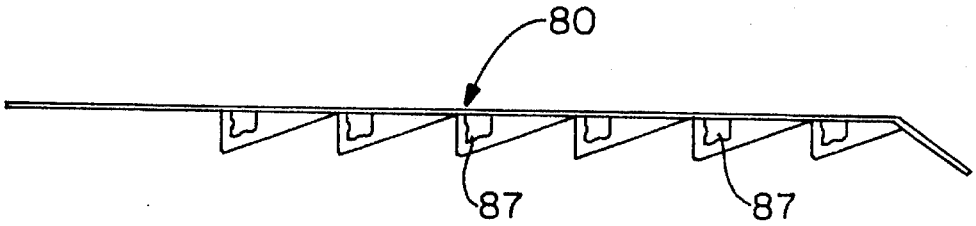
FIG. 5 is a top plan view of the first embodiment panel assembly of FIG. 4.
Figure 4:
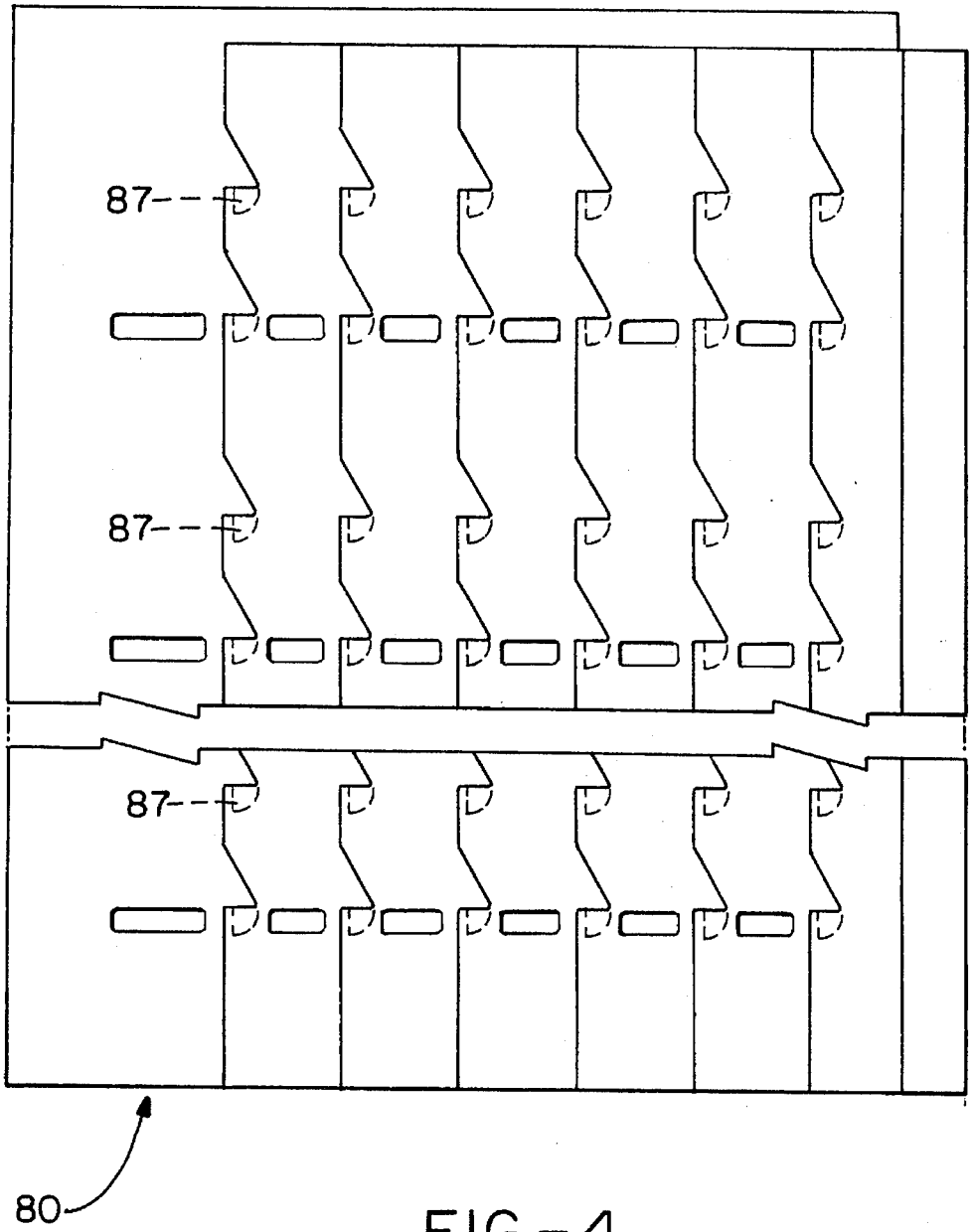
FIG. 4 is a front elevation view of a first embodiment of a panel assembly for positioning in the display rack of the present invention.
Figure 6:
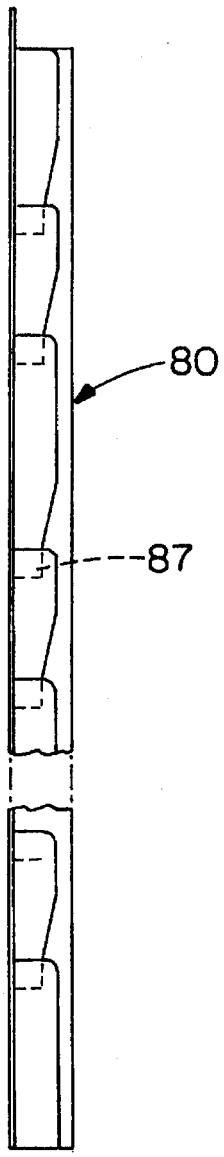
FIG. 6 is a side elevation view of the first embodiment panel assembly of FIG. 4.
Figure 7:
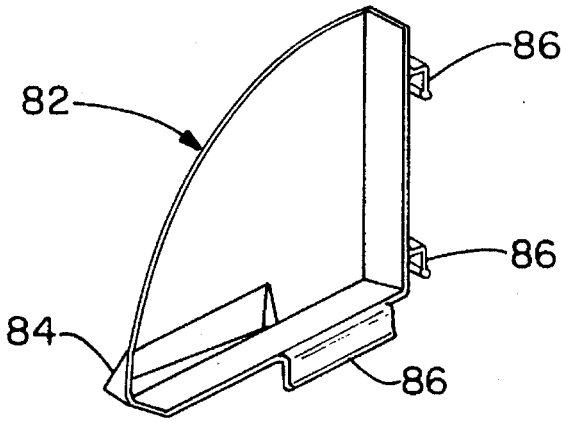
FIG. 7 is a rear perspective view of a card holder for use with the panel assembly of FIG. 4.
Figure 8:
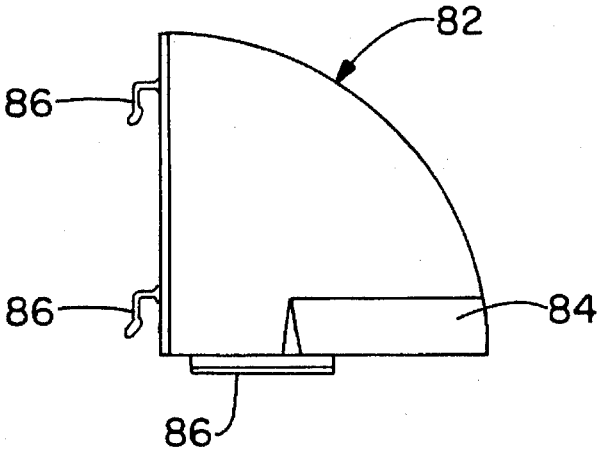
FIG. 8 is a rear elevation view of the card holder of FIG. 7.
Figure 12:
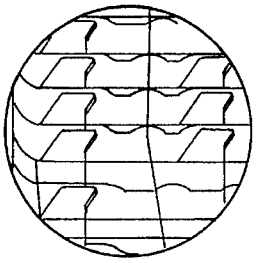
FIG. 12 is an enlarged view of the circled portion of FIG. 11.
Figure 11:
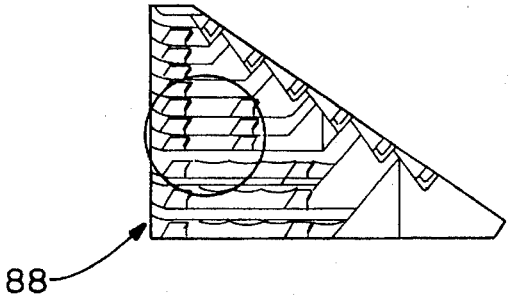
FIG. 11 is a top plan view of the second embodiment panel of FIG. 9.
Figure 10:
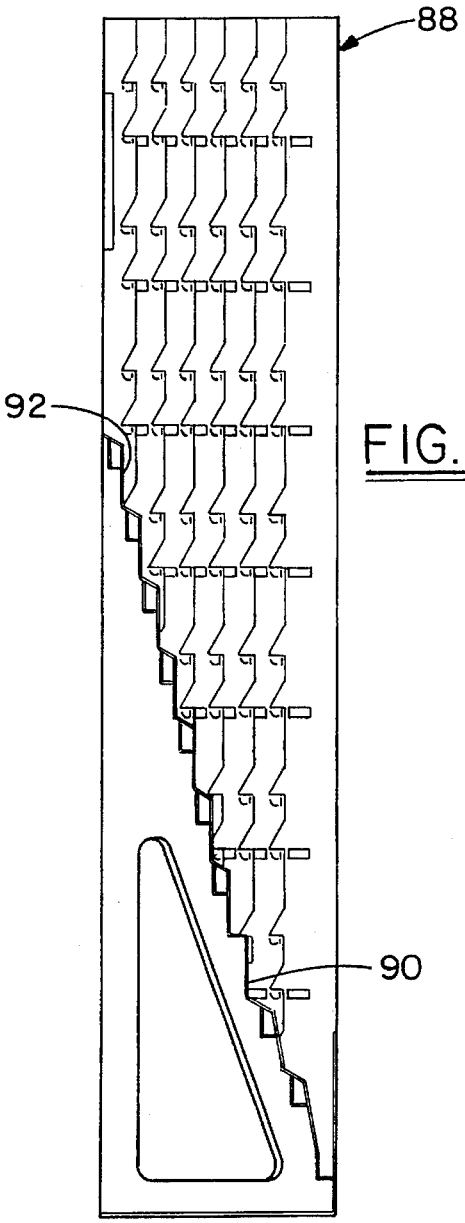
FIG. 10 is a side elevation view of the second embodiment panel assembly of FIG. 9, as viewed from the left side of FIG. 9.
Figure 9:
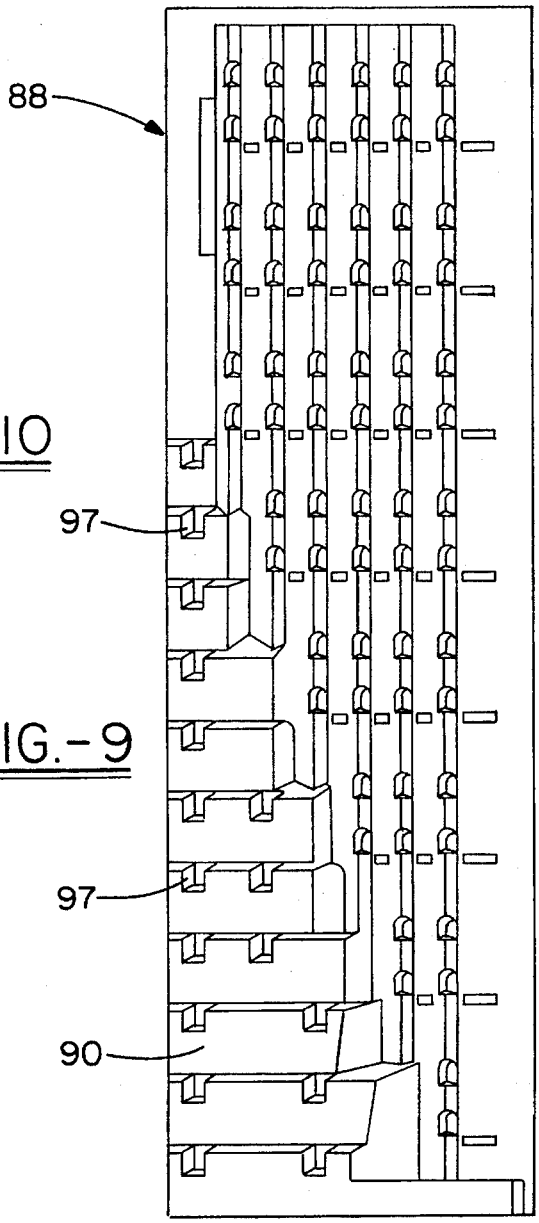
FIG. 9 is a front elevation view of a second embodiment panel assembly for positioning in the display rack of the present invention.

In one particular panel assembly shown in FIGS. 1 and 4–6, the display face 80 provides mounting space for a plurality of sidewardly open greeting card holders 82, which are shown in more detail in FIGS. 7 and 8. The display face shown, which is typically molded, preferably by a vacuum molding technique when the panel assembly is formed, is one version. Due to the symmetrical nature of the display rack, it will be immediately recognized that the display face 80 shown in FIGS. 4–6 represents one version, with the mirror image thereof, which is not illustrated, serving as the second version. To maximize the attractiveness and to fully display the faces of the cards, the card holders 82 are arranged on the display face 80 in a grid fashion comprising a plurality of non-overlapping rows and a plurality of overlapping columns, as particularly shown in FIG. 4. A particularly preferred use of this type of card display is on the panel assemblies 60, 64 that are on the ends of the unit and are not facing another display face, that is, the "orphan"

display faces. One example of this is shown in FIG. 1, where card holders 82 are affixed to the display face 80. The overlapping columns flare outwardly, and the holders 82 should be open on the side facing towards the consumer. A holder 82 used in this type of panel assembly is preferably transparent on its outward face, to provide full viewing of the card face. Because the card holder 82 is open all along one side, the card can be accessed by the consumer from the side, allowing the top row of card holders to be slightly higher than a "top-accessible" card holder while maintaining the same level of accessibility. It may also be useful to provide some or all of these sidewardly open greeting card holders 82 with an angled pocket 84 formed therein for displaying a caption card, to indicate the type of card, such as "Birthday," "Anniversary", etc. The card holders 82 used in this application will typically have a male member 86 molded therein, on a rear or side surface, for mounting in a female member 87 molded into the display face 80 of the panel assembly. While a permanent mount is not desired, a secure mount is clearly desired. The preferred card holder 82 of the present invention will be manufactured from a moldable thermoplastic resin such as a glycol-modified copolyester ("PCTG") of polycyclohexane dimethylene terephthalate, such as is commercially available from Eastman Chemical under the tradename EKTAR DN004.

Reference is now directed to FIGS. 9–12. In the most preferred panel assembly for the facing panels 58, 62 in the focused display area, the panel assembly will not be planar, but will instead be a three-dimensional unit 88 that will coacts with an abutting portion of the other facing panel assembly to form an upwardly-pointed generally triangular display area 90 starting along the first side edge of the rectangular base and ending along the central upstanding support member. This upwardly-pointed generally triangular area 90 is reminiscent of a pyramid. The upwardly-pointing nature of the display directs the customer's eye to a holder for a single card, posed at the apex of the "pyramid." Since this card holder is also the focal point 92 of the lighting means, the effect is enhanced. In the upwardly-pointing generally triangular display area 90, the greeting cards displayed are preferably set out in a plurality of overlapping rows of display shelves, starting from the bottom at the front edge of the base unit and terracing back and up, with each display shelf 94 shorter in length than the display shelf immediately below and in front of it. In addition to serving as display shelves 94, these retainers actually hold the two separate panel assemblies 58, 62 which form the structure for the pyramidal display area 90 in place. This is accomplished by placing male members 96 on at least one of the display shelves 94 (and preferably all of them), with the male members 96 being mated into corresponding female members 97 formed in the display face of each of the facing panel assemblies 58,62. As with the card holders 82 discussed above, the mounting of the display shelves 94 into the panel assembly display face need not be permanent, but must be secure, to hold the respective panel assemblies 58, 62 in abutting relationship. In the particular preferred embodiment envisioned by the inventors, the male members 96 on the display shelf 94 will be angularly positioned so as to enhance the abutment. The preferred material for producing the panel assemblies, including the three-dimensional display 88, of the present invention is a high-impact polystyrene ("HIPS"). The preferred method of forming the panel assemblies is vacuum forming.

Figure 3:
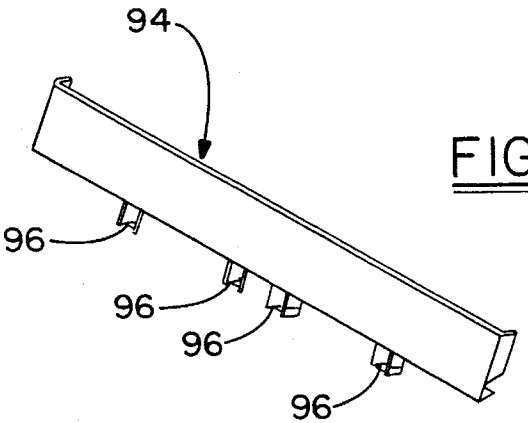
FIG. 3 is a perspective view of a card retainer shelf used in the present invention.

In the preferred embodiment of the present invention envisioned by the inventors, the bottom-most display shelf 98 horizontally aligns one row of greeting cards with a corresponding row of the sidewardly open greeting card holders on the facing panel assemblies 58, 62. One such display shelf is shown in FIG. 3. Due to the terracing nature of the triangular display area 90 and the horizontal non-overlapping nature of the sidewardly-open card holders 82 to the sides thereof, the remaining display shelves 94 present two rows of greeting cards per row of the sidewardly open greeting card holders 82 in the preferred embodiment. This feature increases card density product presentation. As mentioned above, the uppermost display shelf is wide enough to display one greeting card, and will be located at focal point 92. In the preferred embodiment, it will be mounted so that the back of the card will rest against the central upstanding support member 18, or perhaps more precisely, against decorative indicia covering that facing surface of the central upstanding support member. By way of comparison, when the upstanding support members 16, 18, 20 are about 73 inches tall, the top of the card displayed at the focal point 92 of the triangular display area 90 will be about twelve inches below the top of the support members. The card display shelves 94 will preferably be the same material as used in the sidewardly-open card holders, that is, a moldable thermoplastic resin such as a glycol-modified copolyester ("PCTG") of polycyclohexane dimethylene terephthalate, such as is commercially available from Eastman Chemical under the tradename EKTAR DN004.

It is also important to note that several references are made to a "card" being displayed in either the sidewardly-open card holders 82 or on the display shelves 94. While the reference has been to a "card" in the singular, it will be readily understood that what is really meant is a stack comprising at least one card of a single design, along with a corresponding number of appropriately sized envelopes. If only a single card were displayed in the holder 82 or display shelf 94, there would be a constant need to attend to the display to replenish the supply as sales occur. In fact, even further materials may be found in the stack of items we have called a card, such as a backer sheet with serves as a caption card, an inventory card for the display attendant to track sales and stock numbers, a card combining both of these features, or other inserts used to enhance and track sales.

Figure 14:
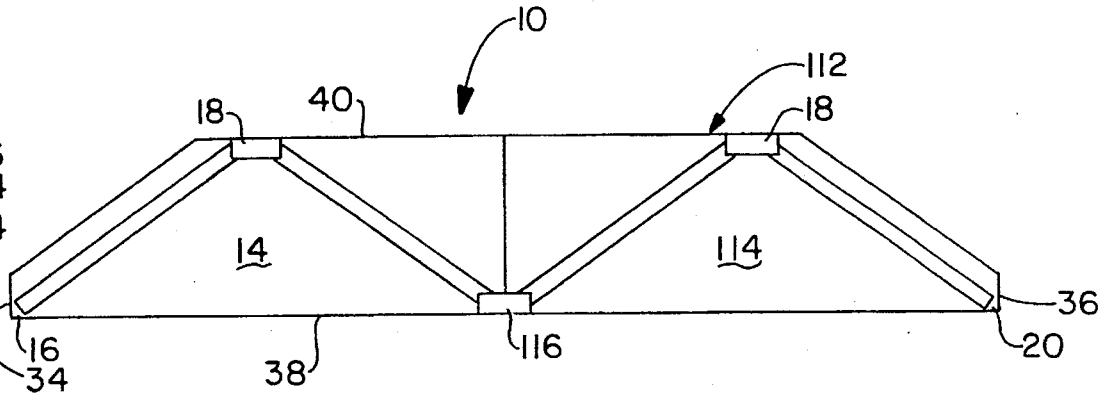
FIG. 14 is a top plan view of a two unit display rack of the present invention.

While reference has been made so far to a display rack 12 using only a single base having a pair of vertical rectangular panel assemblies 58, 62 positioned at an obtuse angle to each other, and which is shown in top plan view in FIG. 13, it will be recognized that this unit is really only the basic building block from which longer linear display racks may be configured. A major feature of the present invention is this modularity. For example, if a first 14 and second 114 base unit are used, as shown in top plan view in FIG. 14, with one end edge of each base in abutment with an end edge of the other, the first base 14 becomes a first rack end unit and the second base 114 becomes a second rack end unit, forming a two-unit long display unit 112. One way to link the two units to act as a single modular unit is to remove an end upstanding support member from each base at the front side edge corner were the bases abut and to replace the end upstanding support members with a connecting upstanding support member 116, which would be shared by the base units and which would be connected by top rails to the central upstanding support member of each base. As shown in FIGS. 13 and 14, when this occurs, the structure is changed (when viewed from the top) from an inverted "V" to an "M", where the outside legs of the "M" are opened in an obtuse angle. It will also be understood that one way of accomplishing this goal is to provide the end upstanding support members 16, 20, which are generally narrower in width than the central upstanding support members 18 anyway, with the capability to be linked with each other to effectively merge them into what has been referred to as the connecting upstanding support member 116. When first 14 and second 114 end units are linked in this manner, the result is a total of three of the particularly preferred display areas formed by a pair of facing rectangular frame areas. Two of these face outwardly towards the first side edge 38, one being on each base unit, and the third faces outwardly towards the second side edge 40. This third preferred display area is formed by one rectangular frame area from each base, which faces a rectangular frame area of the adjoining base unit at an obtuse angle. Just as the central upstanding support member 18 of each base serves as the vertex of the obtuse angle of one of these display areas, the connecting upstanding support member 116 serves as the vertex of the obtuse angle defining the third preferred display area.

Figure 15:
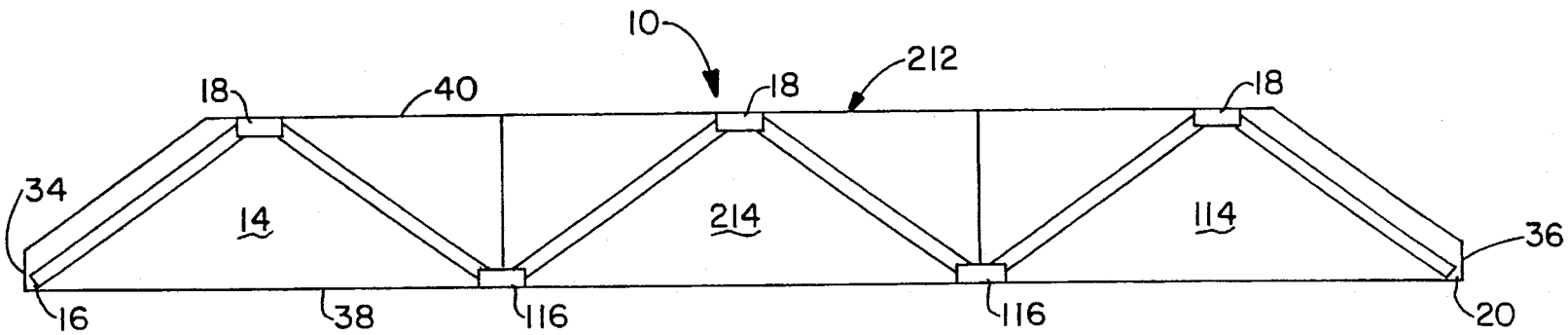
FIG. 15 is a top plan view of a three unit display rack of the present invention.

Once the method of forming a chain of two abutting bases is taught, it becomes clear how to add further links to the chain. As shown in FIGS. 1, 2 and 15, when at least one intermediate rack unit 212 is interposed between the first and second end units described immediately above, the intermediate rack unit 212 will have a base 214, a central upstanding support member 18, and a pair of connecting upstanding support members 116, one positioned at each front or first side edge corner. When these connecting upstanding support members are shared with the rack end units to replace the end upstanding support member that would otherwise be present and the connecting upstanding support members 116 are communicated to the central upstanding support members 18 of the intermediate unit as well as the adjacent rack end unit, then a chain having three of the preferred display areas facing to the front or first side edge 38 will be formed, along with two such areas facing towards the rear or second side edge 40. Having described construction of a linked chain of the bases going from one to three units in length, it will be clear how further units may be added to assemble a chain of the desired length. The upper limit of links in such a chain is set not by any known structural limitation, but is instead set by the requirements or floor limitations of the retail setting where the display will be used. FIGS. 1 and 2 show a partially assembled display rack of this genre, where two end rack units and two intermediate rack units are laid out for assembly.

In these elongate chains 212 of linked rack units, it is desirable to position a lighting means 50 at each central 18 and connecting upstanding support member 116 to provide enhanced lighting. It, therefore, becomes increasingly important to use the top rail 22, 24 as an electrical raceway to daisy-chain the electrical wiring down the display unit, as suggested above. While this electrical raceway functionality could be performed by the bottom rail members 56, if they are used, the distance between the bottom rails and the connections to the individual lighting units, as well as the relative inaccessibility of the bottom rail once the panel assemblies are in place will generally militate against the use of the bottom rails as the raceway.

In some applications, the display rack 10 of the present invention will be freestanding on the floor of the retail operation in which it is used. In other applications, the retailer will provide a mounting, usually called a "gondola", upon which the base will be mounted. In either case, the present invention has no particularly distinctive mounting requirements. If legs are used under the base, they should preferably be of a levelable variety, to assure a level display unit. Such legs are commercially available through Hafele and other manufacturers. In any case, bumper molding or kick plates 102, as shown in FIG. 1, will usually be applied around the entire perimeter of the display rack. While mostly decorative, they serve some utile purpose, such as aiding in holding abutting bases together, particularly at the rear corner where two bases are joined, that is, immediately behind a connecting upstanding support member.

In connecting structural elements of the present invention, the inventors envision the use of gyro bolts having cam stops, such as those manufactured by and available through Hafele as Part No. 261.05.902. These fasteners are unobtrusive and easily operated in the field by an Allen key. The present invention is not, however, dependent upon this feature and other alternative fasteners will be known to those of skill in this art.

While the present invention has been described not only in the best mode and preferred embodiment to comply with the patent statutes, it is to be understood that the invention is not limited thereto, but is instead to be measured by the scope and spirit of the appended claims.

What is claimed is:

1. A rack unit for displaying greeting cards and the like, said rack unit comprising:

a rectangular base having first and second end edges and first and second side edges;

a first end upstanding support member having a base end and a top end, with its base end positioned at a corner of the rectangular base defined by the first end edge and the first side edge, a central upstanding support member, also having a base end and a top end with its base end positioned along the second side edge approximately midway between the first and second end edges, and a second end upstanding support member having a base end and a top end with its base end positioned at a corner of the rectangular base defined by the second end edge and the first side edge, each said upstanding support member extending upward generally normal to the rectangular base;

two top rails, the first said top rail spanning from the top end of the first upstanding support member to the top end of the central upstanding support member so that the first end upstanding support member, the central upstanding support member, the rectangular base and the first top rail form a first rectangular frame area; and the second said top rail spanning from the top end of the second end upstanding support member to the top end of the central upstanding support member so that the second end upstanding support member, the central upstanding support member, the rectangular base, and the first top rail form a second rectangular frame area;

a first and a second panel assembly positioned in each of the first and second rectangular frame areas, said first and second panel assemblies placed in back to back relationship to each other so that a display face on each panel assembly is directed outwardly from the rectangular frame area, with one panel assembly in each of the first and the second rectangular frame areas facing each other at an obtuse angle wherein the central upstanding support member forms a vertex of the obtuse angle;

the display face on each said panel assembly being adapted for receiving a plurality of means for displaying greeting cards or the like.

2. The display rack unit of claim 1 wherein said central upstanding support member is hollow and has a lighting means affixed to the top end thereof, the hollow interior of said central upstanding support member acting as a raceway to provide electrical power from the base to said lighting means.

3. The display rack unit of claim 2 wherein said lighting means comprises a gooseneck having a lamp base with a lamp and a shade at one end thereof and a means for mounting the lighting means to the central upstanding support member at the other end thereof.

4. The display rack unit of claim 3 wherein the lamp base and lamp are positioned to direct its light into a display area formed by the obtuse angle between the panel assemblies in the first and second rectangular frame areas.

5. The display rack unit of claim 3 wherein a crook in said gooseneck has advertising indicia positioned therein.

6. The display rack unit of claim 1 wherein the plurality of means for displaying greeting cards or the like on the display face of each of said panel assemblies comprises a plurality of sidewardly open greeting card holders, said sidewardly open greeting card holders aligned in a plurality of non-overlapping rows and a plurality of overlapping columns.

7. The display rack unit of claim 6 wherein each of the plurality of sidewardly open greeting card holders are open on the side thereof towards the user of the display rack.

8. The display rack unit of claim 7 wherein at least one of the plurality of sidewardly open greeting card holders has an angled pocket formed therein for displaying a caption card.

9. The display rack unit of claim 6 wherein a portion of the display face of each of the panel assemblies that face each other at the obtuse angle coacts with an abutting portion of the other facing panel assembly to form an upwardly-pointed generally triangular display area starting along the first side edge of the rectangular base and ending along the central upstanding support member.

10. The display rack unit of claim 9 wherein the plurality of means for displaying greeting cards or the like in said generally triangular display area comprises a plurality of overlapping rows of display shelves.

11. The display rack unit of claim 10 wherein at least one said display shelf comprises at least two male members, one of said at least two male members to be received into a corresponding female member formed in each of the facing panel assemblies, thereby retaining the facing panel assemblies in abutting relationship.

12. The display rack unit of claim 10 wherein a bottom-most said display shelf horizontally aligns one row of greeting cards with a corresponding row of the sidewardly open greeting card holders on the facing panel assemblies and the remaining said display shelves present two rows of greeting cards per row of the sidewardly open greeting card holders on the facing panel assemblies.

13. The display rack of claim 10 wherein an uppermost said display shelf is wide enough to display one greeting card and is mounted along the central upstanding support member.

14. The display rack unit of claim 10 wherein said central upstanding support member is hollow and has a lighting means affixed to the top end thereof, said central upstanding support member acting as a raceway to provide electrical power from the base to said lighting means.

15. A rack for displaying greeting cards and the like, said rack comprising:

a first and a second rack end unit;

the first said rack end unit comprising:

a rectangular base having first and second end edges and first and second side edges;

an end upstanding support member having a base end and a top end with its base end positioned at a corner of the rectangular base defined by the said first end edge and the first side edge;

a central upstanding support member having a base end and a top end with its base end positioned along the second side edge approximately midway between the first and second end edges;

a first top rail spanning from the top end of the end upstanding support member to the top end of the central upstanding support member, so that the end and central upstanding support members, the rectangular base, and the first top rail form a first rectangular frame area;

a first and a second panel assembly positioned in the first rectangular frame area, the first and second panel assemblies placed in back to back relationship to each other so that a display face on each panel assembly is facing outwardly from the first rectangular frame area; and a connecting upstanding support member having a base end and a top end with its base end positioned at a corner of the rectangular base defined by the second end edge and the first side edge;

a second top rail spanning from the top end of the central upstanding support member to the top end of the connecting upstanding support member, so that the central and connecting upstanding support members, the rectangular base, and the second top rail form a second rectangular frame area;

a first and a second panel assembly positioned in the second rectangular frame area, the first and second panel assemblies placed in back to back relationship to each other so that a display face on each panel assembly is facing outwardly from the second rectangular frame area; and the second rack end unit comprising:

a rectangular base having first and second end edges and first and second side edges, the first end edge of said rectangular base abutting the second end edge of the rectangular base of the first rack end unit, the first and second side edges of the respective rectangular bases being aligned;

the connecting upstanding support member of the first rack end unit being shared by the respective rack end units with the base end thereof positioned at a corner of the rectangular base of the second rack end unit defined by said first end edge and the first side edge;

a central upstanding support member having a base end and a top end with its base end positioned along the second side edge approximately midway between the first and second end edges, a first top rail spanning from the top end of the connecting upstanding support member to the top end of the central upstanding support member, so that the connecting and central upstanding support members, the rectangular base, and the first top rail form a first rectangular frame area;

a first and a second panel assembly positioned in the first rectangular frame area, the first and second panel assemblies placed in back to back relationship to each other so that a display face on each panel assembly is facing outwardly from the first rectangular frame area;

an end upstanding support member having a base end and a top end with its base end positioned at a corner of the rectangular base of the second rack end unit defined by said second end edge and the first side edge of the rectangular base; and a second top rail spanning from the top end of the central upstanding support member to the top end of the end upstanding member, so that the central and end upstanding support members, the rectangular base, and the second top rail form a second rectangular frame area; and a first and a second panel assembly positioned in the first rectangular frame area, the first and second panel assemblies placed in back to back relationship to each other so that a display face on each panel assembly is facing outwardly from the first rectangular frame area;

wherein the display face on each said panel assembly is adapted for receiving a plurality of means for displaying greeting cards or the like; and wherein one said panel assembly in the first rectangular frame area of each rack end unit faces one said panel assembly in the second rectangular frame area at an obtuse angle open towards the first side edge and the central upstanding support member of that rack end unit forms a vertex of the obtuse angle, and the other panel assembly in the second rectangular frame area of the first rack end unit faces the other panel assembly in the first rectangular frame area of the second rack end unit at an obtuse angle open towards the second edge side and the connecting upstanding support member forms a vertex of the obtuse angle open towards the second side edge.

16. A rack for displaying greeting cards and the like, said rack comprising:

a first rack end unit, a linked chain of at least one intermediate rack unit, and a second rack end unit;

the first said rack end unit comprising:

a rectangular base having first and second end edges and first and second side edges;

an end upstanding support member having a base end and a top end with its base end positioned at a corner of the rectangular base defined by the said first end edge and the first side edge;

a central upstanding support member having a base end and a top end with its base end positioned along the second side edge approximately midway between the first and second end edges;

a first top rail spanning from the top end of the end upstanding support member to the top end of the central upstanding support member, so that the end and central upstanding support members, the rectangular base, and the first top rail form a first rectangular frame area;

a first and a second panel assembly positioned in the first rectangular frame area, the first and second panel assemblies placed in back to back relationship to each other so that a display face on each panel assembly is facing outwardly from the first rectangular frame area; and a connecting upstanding support member having a base end and a top end with its base end positioned at a corner of the rectangular base defined by the second end edge and the first side edge;

a second top rail spanning from the top end of the central upstanding support member to the top end of the connecting upstanding support member, so that the central and connecting upstanding support members, the rectangular base, and the second top rail form a second rectangular frame area;

a first and a second panel assembly positioned in the second rectangular frame area, the first and second panel assemblies placed in back to back relationship to each other so that a display face on each panel assembly is facing outwardly from the second rectangular frame area; and the linked chain of at least one intermediate rack unit comprising:

for each of the intermediate rack units, a rectangular base having first and second end edges and first and second side edges, the first end edge of the rectangular base of the first intermediate rack unit abutting the second end edge of the first rack end unit, and the first end edge of the rectangular base of any subsequent intermediate rack unit abutting the second end edge of the adjacent intermediate rack unit and second side edges of the respective rectangular bases being aligned;

for each of the intermediate rack units, the connecting upstanding support member being shared with the adjacent rack units, the first intermediate rack unit sharing the connecting upstanding support member of the first rack end unit and any subsequent intermediate rack units sharing the connecting upstanding support member of the adjacent intermediate rack unit, with the base end thereof positioned at a corner of the rectangular base of the second rack end unit defined by said first end edge and the first side edge;

for each intermediate rack unit, a central upstanding support member having a base end and a top end with its base end positioned along the second side edge approximately midway between the first and second end edges, for each intermediate rack unit, a first top rail spanning from the top end of the connecting upstanding support member to the top end of the central upstanding support member, so that the connecting and central upstanding support members, the rectangular base, and the first top rail form a first rectangular frame area;

for each intermediate rack unit, a first and a second panel assembly positioned in the first rectangular frame area, the first and second panel assemblies placed in back to back relationship to each other so that a display face on each panel assembly is facing outwardly from the first rectangular frame area;

for each intermediate rack unit, a connecting upstanding support member having a base end and a top end with its base end positioned at a corner of the rectangular base of the second rack end unit defined by said second end edge and the first side edge of the rectangular base; and for each intermediate rack unit, a second top rail spanning from the top end of the central upstanding support member to the top end of the connecting upstanding member, so that the central and connecting upstanding support members, the rectangular base, and the second top rail form a second rectangular frame area; and for each intermediate rack unit, a first and a second panel assembly positioned in the first rectangular frame area, the first and second panel assemblies placed in back to back relationship to each other so that a display face on each panel assembly is facing outwardly from the first rectangular frame area; and the second rack end unit comprising:

a rectangular base having first and second end edges and first and second side edges, the first end edge of said rectangular base abutting the second end edge of the rectangular base of the last of the linked chain of at least one intermediate rack units, the first and second side edges of the respective rectangular bases being aligned;

the connecting upstanding support member of the last of the linked chain of at least one intermediate rack units being shared with the second rack end unit with the base end thereof positioned at a corner of the rectangular base of the second rack end unit defined by said first end edge and the first side edge;

a central upstanding support member having a base end and a top end with its base end positioned along the second side edge approximately midway between the first and second end edges, a first top rail spanning from the top end of the connecting upstanding support member to the top end of the central upstanding support member, so that the connecting and central upstanding support members, the rectangular base, and the first top rail form a first rectangular frame area;

a first and a second panel assembly positioned in the first rectangular frame area, the first and second panel assemblies placed in back to back relationship to each other so that a display face on each panel assembly is facing outwardly from the first rectangular frame area;

an end upstanding support member having a base end and a top end with its base end positioned at a corner of the rectangular base of the second rack end unit defined by said second end edge and the first side edge of the rectangular base; and a second top rail spanning from the top end of the central upstanding support member to the top end of the end upstanding member, so that the central and end upstanding support members, the rectangular base, and the second top rail form a second rectangular frame area; and a first and a second panel assembly positioned in the first rectangular frame area, the first and second panel assemblies placed in back to back relationship to each other so that a display face on each panel assembly is facing outwardly from the first rectangular frame area;

wherein the display face on each said panel assembly is adapted for receiving a plurality of means for displaying greeting cards or the like; and wherein one said panel assembly in the first rectangular frame area of each rack end unit and each of the linked chain of at least one intermediate rack units faces one said panel assembly in the second rectangular frame area at an obtuse angle open towards the first side edge and the central upstanding support member of that rack end unit or intermediate rack unit forms a vertex of the obtuse angle, and the other panel assembly in the second rectangular frame area of the first rack end unit and each of the intermediate rack units in the linked chain of at least one intermediate rack units faces the other panel assembly in the first rectangular frame area of the immediately adjacent rack unit at an obtuse angle open towards the second edge side and the connecting upstanding support member forms a vertex of the obtuse angle open towards the second side edge.

* * * * *